US006994901B1

(12) United States Patent
Chen et al.

(10) Patent No.: US 6,994,901 B1
(45) Date of Patent: Feb. 7, 2006

(54) HEAT SHIELD HAVING A FOLD-OVER EDGE CRIMP WITH VARIABLE WIDTH AND METHOD OF MAKING SAME

(75) Inventors: Colin C. Chen, Barrington, IL (US); Frank W. Popielas, Naperville, IL (US); Mark Boogemans, Belmont (CA); Calin Matias, London (CA); Ryan P. Moffat, London (CA); Marsha A. Minkov, Wheeling, IL (US)

(73) Assignee: Dana Corporation, Toledo, OH (US)

( * ) Notice: Subject to any disclaimer, the term of this patent is extended or adjusted under 35 U.S.C. 154(b) by 2 days.

(21) Appl. No.: 10/292,642

(22) Filed: Nov. 12, 2002

(51) Int. Cl.
*B32B 3/04* (2006.01)

(52) U.S. Cl. ..... 428/121; 428/68; 428/71; 428/74; 428/75; 428/174; 428/192; 428/920; 428/921; 29/513; 29/462

(58) Field of Classification Search ..... 428/121, 428/68, 71, 74, 75, 174, 192, 920, 921; 29/513, 29/462
See application file for complete search history.

(56) References Cited

U.S. PATENT DOCUMENTS 4,273,836 A 6/1981 Campbell et al.
4,351,292 A 9/1982 Worthen et al.
5,167,060 A * 12/1992 Nawrocki et al. ..... 29/513
5,590,524 A 1/1997 Moore, III et al.
5,958,603 A 9/1999 Ragland et al.
6,052,887 A 4/2000 Dziadosz et al.

* cited by examiner

*Primary Examiner*—Patrick Joseph Ryan
*Assistant Examiner*—Jane Rhee
(74) *Attorney, Agent, or Firm*—Rader, Fishman & Grauer PLLC

(57) ABSTRACT

An improved heat shield provides for reduced noise transmission of vehicular engine components is disclosed. The heat shield has three layers; a first sheet layer, a center insulation layer, and a second sheet layer. The insulation layer is positioned between the first and second sheet layers. The first sheet layer is defined by a variable shaped periphery that is folded over the periphery of the second sheet layer to form a hem having a variable length around the heat shield. The variable length serves to reduce uneven strain in the hem area experienced during crush forming the heat shield into the final shape. Further, the variable length of the hem also serves to alter the resonate frequency of the heat shield in specific areas to reduce vibration and improve acoustical properties.

10 Claims, 2 Drawing Sheets

HEAT SHIELD HAVING A FOLD-OVER EDGE CRIMP WITH VARIABLE WIDTH AND METHOD OF MAKING SAME

BACKGROUND OF THE INVENTION

1. Field of the Invention

The present invention relates generally to protective structures for vehicular engine parts such as engine exhaust manifolds that generate substantial heat and vibration during engine operation. More specifically, the invention relates to fabrication of a protective heat shield applied to such engine parts, and particularly to a method of fabricating a heat shield having a fold-over crimp at its edge.

2. Description of the Prior Art

The exhaust manifolds of internal combustion engines in today's modern vehicles can reach under-the-hood temperatures in the neighborhood of 1600 degrees Fahrenheit. Such high temperatures create significant risks of damage to electronic components sharing under-the-hood space with the manifolds. Thus, protection has been provided for such components by the use of heat shields designed to at least partially cover up and insulate exhaust manifolds and other heat generating components. In some cases, the heat shields have been effective to reduce measured temperature levels to within a range of 300 degrees Fahrenheit.

One recurrent shortcoming with respect to current heat shield designs, however, has been the inability to reduce or attenuate noise down to satisfactory levels. Generally, the insulation layer is normally the center layer interposed between two metal layers, is relatively thin, and has a relatively high density that makes the insulation layer rather stiff. The insulation layer, while often quite adequate to thwart heat transfer at desired values, has been stubbornly insufficient to dampen noise. Unfortunately, the relatively stiff and thin structures for producing heat shields tend to be prone to producing echoes rather than absorbing vibrations and/or noise.

Another shortcoming of known heat shield designs is that the method for forming the heat shield components often leaves the components vulnerable to cracking problems. Known heat shield designs are formed from superimposed sheet metal layers that are typically joined together in a conventional hemming operation, where the outer periphery of one of the layers is crimped over the outer periphery of the other layer. One known method for performing the crimping operation is crush forming. Referring to FIGS. 1 and 2, in the crush forming process, the edge 12 of a heat shield component 14 has a fold over portion or a hem area 16 where the length L of the fold over is generally constant such that the hem reinforces the strength of the edge of the heat shield evenly. The material being formed into the heat shield component is then crushed into the form of the heat shield.

However, the crush forming process generates uneven elongation in various parts of the edge of the heat shield component being formed. More specifically, the higher the curvature or deeper the drawing area in the part being formed, the higher strain experienced in the part. High strain areas exceed cracking limits and may result in an unsuccessful part. Accordingly there is a need for an improved crush forming process for forming heat shields that alleviates potential cracking problems in the hem area.

SUMMARY OF THE INVENTION

The present invention provides an improved method for crush forming heat shield components for a variety of heat generating components, such as engine exhaust manifolds for internal combustion engines, engine mounts, and catalytic converters for exhaust systems. In accordance with one embodiment of the present invention, a method for crush forming heat shield components includes providing at least two sheets of suitable material, a first sheet and a second sheet. An insulating layer may also be provided.

The first and second sheets and the optional insulating material are positioned together with the optional insulating material being sandwiched between the first and second sheets. The first sheet, which is sized to be generally larger than the second sheet, is defined by a peripheral edge. In accordance with the present invention, the peripheral edge is folded over the outer surface of the second sheet to secure the heat shield components together. The hem of the first sheet is sized such that the depth of the hem along its length is varied. In other words, some portions of the hem have a predetermined depth that is larger than other portions of the hem. Once folded over, the heat shield components are crush formed into the final shape. A peripheral edge of the second sheet that is captured by the hem is crushed inwardly such that the hem is generally in the same plane as the outer surface of the second sheet.

The varied depth of the hem alleviates difficulties encountered with constant depth hems. More specifically, the varied depth of the hem of the present invention compensates for uneven strain and elongation distribution encountered by the crush forming process. The elongation distribution of the first sheet can be calculated using general standards in the industry dependant upon the material used to make the heat shield components and the degree of desired bending. With incremental analysis, the crush forming process may be simulated such that the appropriate depth of the hem in predetermined locations can be chosen to reduce cracking problems in the hem area. Additionally, the varied depth of the hem also may be used to alter resonate frequency of the heat shield in specific, predetermined areas to reduce vibration and also to improve acoustical properties.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE PREFERRED EMBODIMENTS

Figure 1:
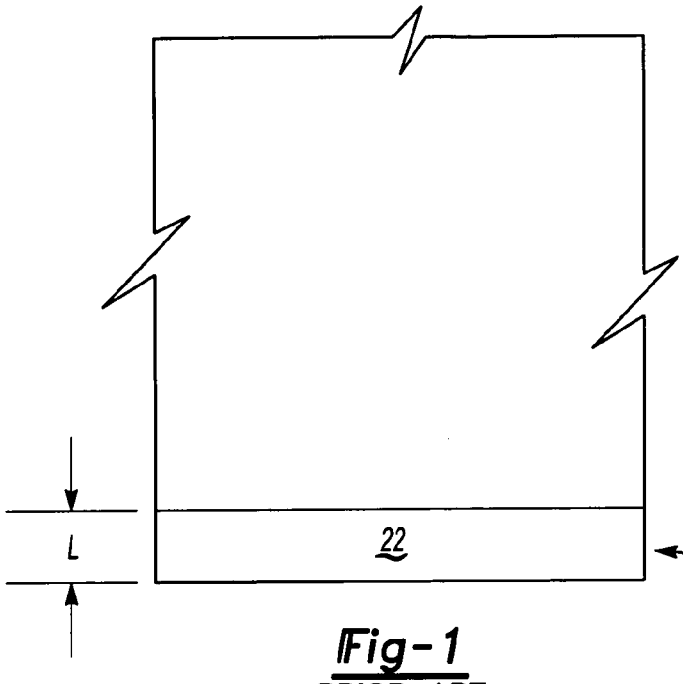
Fig-1 PRIOR ART
FIG. 1 is a planar view of a section of a heat shield component that is known in the prior art.
Figure 2:
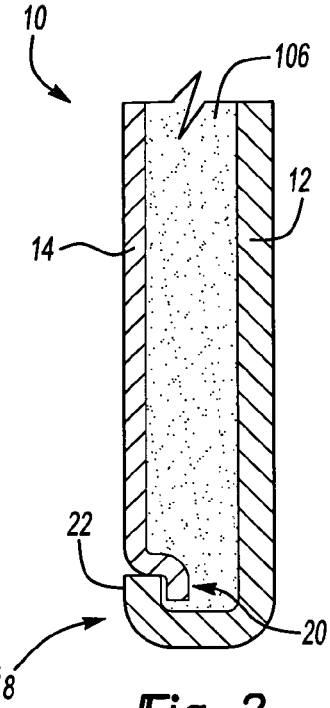
Fig-2 PRIOR ART
FIG. 2 is a cross-sectional view of the prior art heat shield of FIG. 1.
Figure 3:
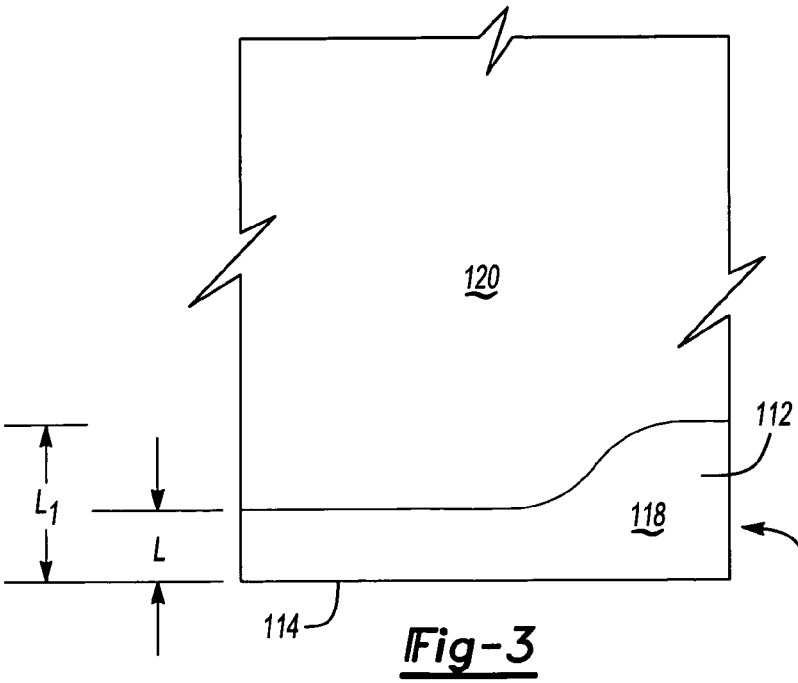
FIG. 3 is a planar view of a section of a heat shield component in accordance with the present invention.

Referring initially to FIGS. 1 and 2, a prior known multi-layered heat shield 10 is adapted to encase or closely surround at least portions of an under-the-hood engine component. Heat shield 10 has generally three layers, a first sheet layer 12, a second sheet layer 14 and a layer of insulating material 16. First sheet layer 12 is defined by a peripheral edge 18. The first and second sheet layers 12, 14 are stamped from sheet metal, and formed in a progressive die to predetermined shapes. Optional insulating material 16 may then be applied against the first sheet layer 12 to isolate temperature and to dampen vibration and noise. Second sheet layer 14 is placed over the insulating material 16.

First sheet layer 12 is relatively and slightly oversized compared to second sheet layer 14 such that peripheral edge 18 having a substantially equal depth L of first sheet layer 14 is folded over a peripheral edge 20 of second sheet layer 14. Accordingly, insulating material 16 is effectively encapsulated between the sheet layers 12 and 14. Peripheral edge 18 of first sheet layer 12 provides a generally constant depth hem 22 when folded over second sheet layer 14. Once peripheral edge 18 is folded over peripheral edge 20 of second sheet layer 14, heat shield 10 is subjected to a crush forming process whereby heat shield 10 is subjected to force to deform heat shield 10 into a predetermined shape. However, because the crush forming process generates uneven elongation in various parts of hem 22, higher strain is created, often resulting in cracks.

Referring to FIGS. 3–6, in accordance with the present invention, a heat shield 100 is provided having at least two sheet layers, a first sheet layer 102 and a second sheet layer 104. An insulating layer 106 is also preferably provided. First and second sheet layers 102 and 104 are cut or stamped into a first predetermined shape and size. First sheet layer 102 is defined by a periphery 108. Unlike prior art heat shields, periphery 108 has a variable shape (best seen in FIG. 3) as will be explained in further detail below. In one embodiment, periphery 108 has a waved shape. However, it is understood that other shapes for periphery 108 are contemplated. Second sheet layer 104 is also defined by a periphery 110, but is sized to be somewhat smaller than first sheet layer 102.

Figure 4:
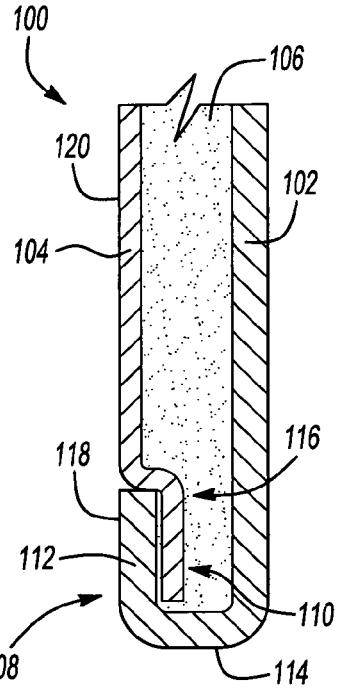
FIG. 4 is a cross-sectional view of the heat shield component fabricated in accordance with the present invention.

To fabricate heat shield 100, insulating layer 106 is positioned between first and second sheet layers 102 and 104, as seen in FIG. 4. Periphery 108 is folded over periphery 110 to form a hem 112. As can be seen FIG. 3, hem 112 has a generally lateral outer edge 114, but unlike the prior art, hem 112 also includes a variable depth $L_1$ along its length. Once periphery 108 folded over, heat shield 100 is subjected to a crush forming process wherein heat shield 100 is deformed into a predetermined shape. The crush forming process deforms a portion 116 of said second layer 104 such that an outer surface 118 of hem 112 is generally planar with an outer surface 120 of second layer 104. As a final step, one or more bolt holes (not shown) may be formed to permit ease of attachment of heat shield 100 to a vehicle.

Figure 5:
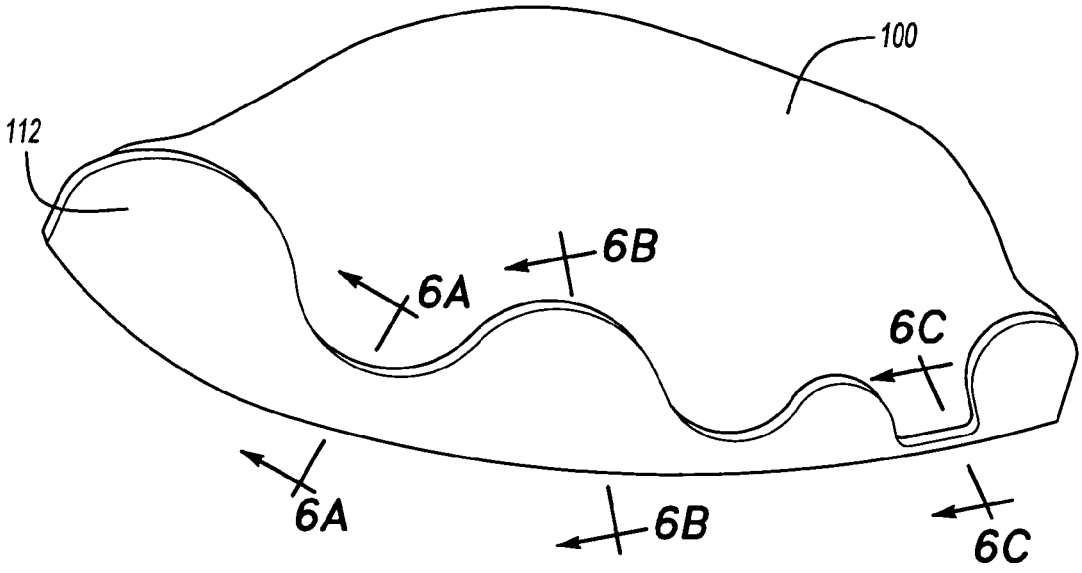
FIG. 5 is a perspective view of the heat shield component fabricated in accordance with the present invention.
Figure 6A:
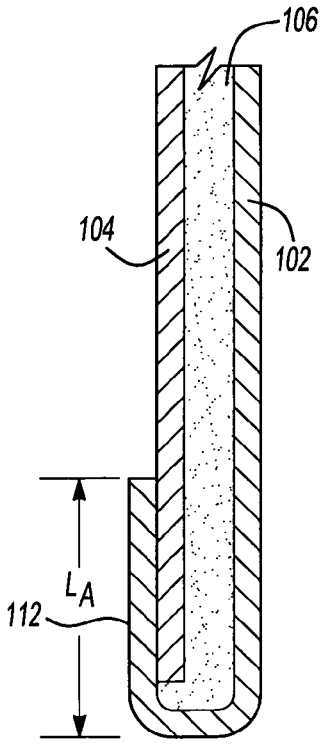
FIGS. 6A–6C are cross-sectional views of the heat shield of FIG. 5 along lines A—A, B—B and C—C, respectively.
Figure 6B:
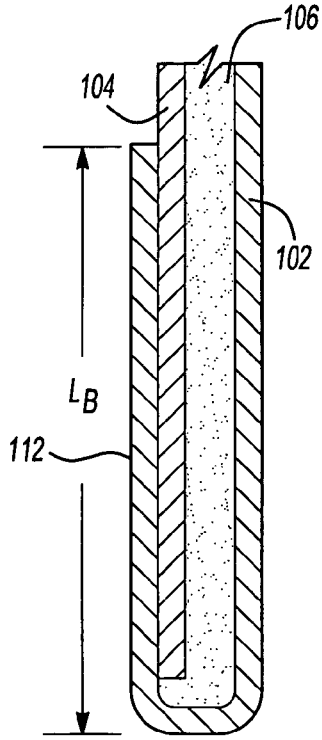
Figure 6C:
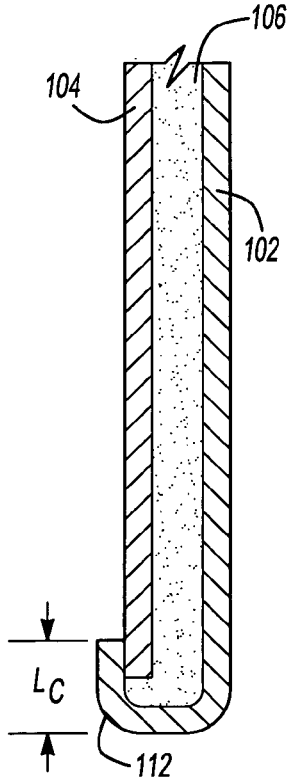

Variable depth $L_1$ advantageously accounts for elongation experienced in areas of the heat shield that have a higher degree of curvature or a deeper drawing area, such that cracking problems are minimized. Further, variable depth $L_1$ also is used to alter the resonate frequency of heat shield 100 in predetermined areas to reduce vibration and improve acoustical properties. Turning to FIGS. 5–6, hem 112 is shown as having multiple varied $L_1$. For example, as shown more clearly in FIGS. 6A–6C, the depth $L_A$ of hem 112 in section A—A is shorter than the depth $L_B$ of hem 112 in section B—B, where heat shield 100 may experience more elongation. In areas of very tight curvature, to insure against cracking during the forming process, it may be necessary to eliminate a hem 112 altogether. For example the depth $L_C$ of hem 112 in section C—C is limited such that there is no fold-over.

To determine the areas of heat shield 100 that should be provided with an increased depth $L_1$, the elongation distribution of areas that experience bending or deformation must be calculated. The calculated elongation distribution is then compared to an incremental analysis of a simulated crushing process to pinpoint areas of heat shield 100 that may experience uneven elongation distribution. More specifically, a formability plot may be calculated using general standards in the industry dependant upon the material used to make heat shield 100 and the degree of desired bending in forming heat shield 100 into the predetermined shape. Incremental modal analysis is used to simulate the crush forming process to determine which areas require additional material to compensate for uneven elongation distribution.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A heat shield for an under-the-hood vehicular engine component comprising:

at least two outer layers; a first layer and a second layer, wherein said first layer is adapted to be positioned directly proximal to a shielded components; and wherein said first layer is defined by a first periphery and said second layer is defined by a second periphery, said first periphery being larger than said second periphery;

wherein said first periphery has a varied shape such that an edge of said first periphery is at least in part, curved in a non-linear manner;

wherein a section of said first periphery is folded over said second periphery so as to form a hem, said hem having a varied depth along the length of said hem around said heat shield, said varied depth resulting, at least in part, from said curved first periphery.

2. The heat shield of claim 1, wherein said first periphery has a waved shape.

3. The heat shield of claim 1, wherein said first and second layers are formed from a metallic material.

4. The heat shield of claim 1, further including an insulating layer positioned intermediately between said first and second layers.

5. The heat shield of claim 1, wherein at least a portion of said first periphery has a length that is approximately equal to a length of said second periphery such that when said first periphery is folded over said portion does not overlap said second periphery.

6. A heat shield for an under-the-hood vehicular engine component comprising:

at least two outer layers; a first layer and a second layer, wherein said first layer is adapted to be positioned directly proximal to a shielded component; and wherein said first layer is defined by a first periphery and said second layer is defined by a second periphery, said first periphery being larger than said second periphery;

wherein said first periphery has a varied shape such that an edge of said periphery is uneven;

wherein a section of said first periphery is folded over said second periphery so as to form a hem, said hem having a varied depth along the length of said hem around said heat shield, wherein said hem defines a plurality of hem portions and at least one hem depth transition portion, wherein said hem portions define at least two depths, and wherein said hem depth transition portion is provided between two of said hem portions; and wherein a portion of said second layer is deformed inwardly where said hem contacts said second layer such that an outer surface of said hem is generally planar with an outer surface of said second layer.

7. The heat shield of claim 6, wherein said first periphery has a waved shape.

8. The heat shield of claim 6, wherein said first and second layers are formed from a metallic material.

9. The heat shield of claim 6, further including an insulating layer positioned intermediately between said first and second layers.

10. The heat shield of claim 6, wherein at least a portion of said first periphery has a length that is approximately equal to a length of said second periphery such that when said first periphery is folded over said portion does not overlap said second periphery.

* * * * *